United States Patent [19]

Hertell et al.

[11] Patent Number: 4,750,867

[45] Date of Patent: Jun. 14, 1988

[54] REGULATING PUMP

[76] Inventors: Siegfried Hertell, am Kattenbusch 22a, 5608 Radevormwald; Dieter Otto, Holberg 108, 5828 Ennepetal, both of Fed. Rep. of Germany

[21] Appl. No.: 32,339

[22] PCT Filed: May 6, 1986

[86] PCT No.: PCT/DE86/00186

§ 371 Date: Jan. 9, 1987

§ 102(e) Date: Jan. 9, 1987

[87] PCT Pub. No.: WO86/06797

PCT Pub. Date: Nov. 20, 1986

[30] Foreign Application Priority Data

May 9, 1985 [DE] Fed. Rep. of Germany ..... 3516718

[51] Int. Cl.[4] ..... F04B 49/02

[52] U.S. Cl. ..... 417/295; 417/307; 417/310

[58] Field of Search ..... 417/295, 307, 302, 310; 418/15, 61 R

[56] References Cited

U.S. PATENT DOCUMENTS 1,861,155 5/1932 Douglas .
2,916,999 12/1959 Christenson et al. .

FOREIGN PATENT DOCUMENTS 409134 1/1924 Fed. Rep. of Germany .
2425022 12/1975 Fed. Rep. of Germany .
2758376 7/1979 Fed. Rep. of Germany .
2933084 8/1981 Fed. Rep. of Germany .
3210759 10/1983 Fed. Rep. of Germany .
3444859 6/1985 Fed. Rep. of Germany .
3506629 10/1985 Fed. Rep. of Germany .
912425 8/1946 France .
9359 6/1916 United Kingdom .
2049823 12/1980 United Kingdom .
2069609 8/1981 United Kingdom .

*Primary Examiner*—William L. Freeh
*Attorney, Agent, or Firm*—Bell, Seltzer, Park & Gibson

[57] ABSTRACT

A hydraulic gear pump is disclosed wherein the meshing teeth of the gears define fluid cells which are expanded in the intake portion and receive the fluid from an inlet, and then compressed in the discharge portion to expel the fluid. The fluid is expelled to a common discharge chamber through a plurality of outlets which are positioned along the rotational direction and which are separated by a distance corresponding to the pitch of the gear teeth. The inlet to the pump includes at least two parallel lines which are each connected to a tank, and the first line is provided with a fixed throttle, and the second line is provided with a pressure control valve which is controlled by the pressure in the pump discharge chamber. The inlet may include a third parallel line, which is provided with a further valve and which is controlled by an externally monitored parameter.

10 Claims, 2 Drawing Sheets

REGULATING PUMP

BACKGROUND OF THE INVENTION

The present invention relates to a hydraulic pump, of the type having an output which is speed dependent up to a limiting value, and wherein beyond the limiting value, the output remains substantially constant irrespective of the speed.

Pumps having the above characteristics may be designed and constructed as rotary vane pumps, with the eccentricity of the rotor and the stator being adjustable in response to the load. However, in many cases, the additional structural requirements associated with pumps of the above type are not economically justified. Accordingly, it is an object of the present invention to provide a hydraulic pump having the described characteristics and which includes a rigidly constructed pump structure, and wherein the controlling action results from its design and does not require additional mechanical means.

Pumps having the above characteristics are commonly used as the lubricating oil pump for the internal combustion engine of an automobile, and where the speed of the engine and thus the rotary speed of the pump constantly changes. As is well known, the output pressure of such a pump is low when the engine speed is low, and as the speed of the engine increases, the output pressure of the pump also increases until a predetermined pressure value is reached. Pumps for this use commonly have a pressure relief valve which opens and diverts a portion of the pump output through a throttle and to a sump when the predetermined pressure value is reached, which of course represents a waste of energy. It is accordingly another object of the present invention to provide a hydraulic pump of the described type and which is energy efficient at high operating speeds.

SUMMARY OF THE INVENTION these and other objects and advantages of the present invention are achieved in the embodiment illustrated herein by the provision of a hydraulic pump which comprises a pump housing, rotary means rotatably mounted within the pump housing and defining fluid cells which are alternately expanded and compressed during rotation of the rotary means. Fluid inlet means is provided which extends through the housing for delivering a fluid to each of the fluid cells while the fluid cells are in an expanded condition, and fluid outlet means is provided which extends through the housing and communicates with the fluid cells during compression thereof and such that the fluid in the fluid cells is expelled through the fluid outlet means. In accordance with the present invention, the fluid inlet means includes a first fluid line having a throttle therein for limiting the fluid flow rate therethrough, and a second fluid line which is parallel to the first line. The second line includes a pressure controlled valve therein, and control means operatively interconnects the pressure control valve and the fluid outlet means and so as to open the pressure control valve when the pressure in the fluid outlet means is below a predetermined value and to close the pressure control valve when the pressure in the fluid outlet means is above a predetermined value.

In the preferred embodiment, the rotary means comprises a toothed internal gear rotatably mounted within the housing to define a central axis, and a toothed external or pinion gear mounted within the housing for rotation about an axis which is eccentric to the central axis. The teeth of the external gear mesh with the teeth of the internal gear and such that the interengaging teeth define the above described fluid cells, which are alternately expanded and compressed upon rotation of the gears.

The gear tooth system of the gear pump is constructed so that the flanks of the teeth which are located between the intersections of the addendum circles mesh with each other, and so that the spaces between the meshing teeth form the individual fluid cells as described above. The cells are effectively sealed from each other in the circumferential or rotary direction. Also, the meshing engagement of the associated teeth of the gears advantageously starts initially in the area of the intersection of the addendum circles. Depending on the requirements, it is possible that the meshing engagement of the teeth does not extend fully up to the intersection of the addendum circles, and it should be understood that a meshing engagement does not necessarily require a mechanical contact. Rather, the gears may be described as being in a meshing engagement when the spacing between their flanks results in such a narrow gap that the gap may be considered a hydraulic seal, when the viscosity of the hydraulic fluid is taken into account.

The throttle in the first fluid line of the above described hydraulic pump provides for a throttling of the fluid entering the inlet port of the pump, i.e., the cross section of the fluid line may be sufficiently small, or reduced by the installation of a throttle, such that at a given pressure gradient, only a limited quantity of the fluid can flow through the inlet port and into the pump.

The fluid outlet means of the pump preferably includes a separate outlet associated with substantially each fluid cell on the discharge side of the pump, i.e., where the fluid cells are being compressed as a result of the meshing engagement of the teeth. Several of these outlets may terminate in a common outlet pressure chamber, and the others may be directed to separate pressure systems. Alternatively, all of the outlets may terminate in a common pressure chamber. Aside from a few exceptions, all outlets include a one-way valve, which allows flow in the direction of discharge, the only exception being the fluid cell adjacent the pitch point, or possibly also the next adjacent cell. These cells may open freely into the pressure duct. In this regard, the spacing in the rotary direction between the outlets generally corresponds to, or is less than, the pitch of the gear teeth.

With the above construction, several outlets are successively aligned in the direction of rotation of the meshing gear teeth, and at least the upstream outlets are sealed by an arrangement of one way valves. The arrangement is so designed that the cells form along the discharge area of the pump open to the outlet pressure chamber only when the increasing compression results in the operating pressure in the pressure chamber being reached in the respective fluid cell.

The present invention also involves a tooth configuration, which insures that the flanks of the teeth of the two gears in the discharge area, i.e., between the intersections of the addendum circles, come into proper contact with each other and so that the gap formed between the two flanks of the meshing teeth may be considered to be hydraulically sealed, and so that the pump operates noiselessly. In this regard, the teeth are so shaped that their flanks which mesh with each other contact or are opposite to each other over the largest possible surface. As a result, adjacent fluid cells are sealed from each other by the longest possible gap. To this end, the tooth system may have cycloidal flanks. In a preferred embodiment, the cycloidal tooth system is designed to have a curved line of surface contact, which extends from the point of contact to the intersection of the two addendum circles. The radius of curvature of the surface contact line preferably has a value which in its dimensions lies between the radius of the pitch circle of the teeth of the internal gear and the radius of the pitch circle of the teeth of the external gear.

The surface contact line may be a curved line having a radius of curvature which changes steadily within specified limits, or it may be located on a circle, the radius of which is fixed within the previously specified limits.

In a further specific embodiment, the selected gear tooth system has a unique configuration, in that the pitch circles are displaced relative to the normal position. Thus, in the case of the internal gear, the distance between the pitch circle and the addendum circle is greater than the distance between the pitch circle and the addendum circle. In the case of the external gear, the distance between the pitch circle and the addendum circle is greater than the distance between the pitch circle and the dedendum circle. Advantageously, the ratio of the larger portion of the tooth height to the smaller portion is at least 2:1 and, preferably, ranges from 3.5:1 to 5:1.

In the case of a stationary internal gear and a rotating external or pinion gear, the center of curvature of the surface contact line describes a circular arc. Thus in the case of a stationary internal gear and a rotating external gear, the lines of surface contact associates with the individual teeth of the external gear are each located on an associated circular arc, with the instantaneous center of the arc being located on a circle which is concentric to the external gear.

The gear pump of the present invention has a delivery and output characteristic which increases with the speed of the pump only to a certain predetermined level. When this speed is exceeded, the rotating fluid cells are only partially filled, i.e., the filling decreases as the speed increases. Possible disadvantageous consequences resulting from cavitation and erosion resulting from such cavitation, are avoided in that in accordance with the present invention, the gear pump provides fluid cells which are sealed relative to each other, and the discharge outlet arrangement is designed to have several outlets which are arranged along the circumferential direction and which are closed by one-way valves. This feature of the invention provides that the only partially filled fluid cells are connected with the cells under pressure and with the outlet chamber only when the pressure of a partially filled cell has reached the pressure of the outlet chamber, thereby avoiding implosions by cavitation.

The partial filling of the fluid cells in the intake area of the pump results from the constant throttling of the intake line, and which permits only a limited fluid flow to enter, thereby preventing the complete filling of each fluid cell during the available filling time which is predetermined by the pump speed. However, in the present invention, an additional throttle is installed in the inlet which is adapted to the application and operation of the pump. In particular, an advantageous further feature of the invention makes it possible to design the throttle for adjustment, so that the output of the pump can be adapted to a specific requirement. Similarly, it is advantageous to install such an adjustable throttle in a control circuit, which permits the quantity delivered to be constant, or to adapt the delivery to a predetermined nominal value. These features render the hydraulic pump of the present invention particularly suitable for use as a lubicrating oil pump in an automobile. The internal combustion engine of an automobile is unique in the fact that it is operated at very different and always changing operating parameters, starting with the idling and ending with an operation under maximum load and at very high speed. A lubicrating oil system must, therefore, satisfy the maximum load conditions, but at the same time it should not consume energy unnecessarily at the lower load ranges.

An internal combustion engine for an automobile should meet the further requirement of long service life without extensive maintenance. This is rendered difficult by the fact that the engine is subjected to wear, which leads to an increased consumption of lubricating oil and to a pressure drop in the lubricating oil system. The lubricating oil pump must, therefore, be adaptable to this increasing need during the course of its service life, and this increased capacity results in corresponding energy losses when the increased capacity is not needed.

The hydraulic pump of the present invention provides a lubricating oil system, which delivers an adequate quantity of lubricating oil under all operating conditions, and at the same time prevents an unnecessary, excessive delivery. Specifically, the present invention provides that the fixed throttle is circumvented by the second fluid inlet line which serves to by-pass the throttle, and with a valve being located in the by-pass line and which is controlled by the discharge pressure of the pump to open the by-pass when the pressure drops in the discharge line.

In the present control system, the fixed throttle is so adjusted that the quantity of oil which is delivered by the pump is dependent on the speed only up to a predetermined speed. This, for example, takes into account the fact that the lubricating oil consumption of the motor is speed dependent in the lower speed ranges. On the other hand, it is believed that the dependency of the lubricating oil consumption on the speed exists only up to a certain speed, and this threshold speed can be predetermined by the dimensioning of the throttle.

The control system of the present system may be adapted to any increased, additional requirement, which may for example be required by wear, in that the pressure drop is monitored and used for opening the by-pass through the second fluid inlet line. The opening of the by-pass permits the entire delivery capacity or an additional portion of the delivery capacity of the pump to be made available.

An advantageous embodiment of the present invention provides that the by-pass makes available only a portion of the total delivery capacity. In addition, the increasing delivery capacity makes it possible for special requirements to be met which are not pressure dependent. Thus for example, it is possible to increase the circulation of the lubricating oil when the temperature of the oil exceeds a certain value, and for this purpose, a further or third parallel inlet line is provided, which provides another by-pass of the fixed throttle and valve, and which is actuated by an electromagnetic valve.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF THE PREFERRED EMBODIMENT

Figure 1:
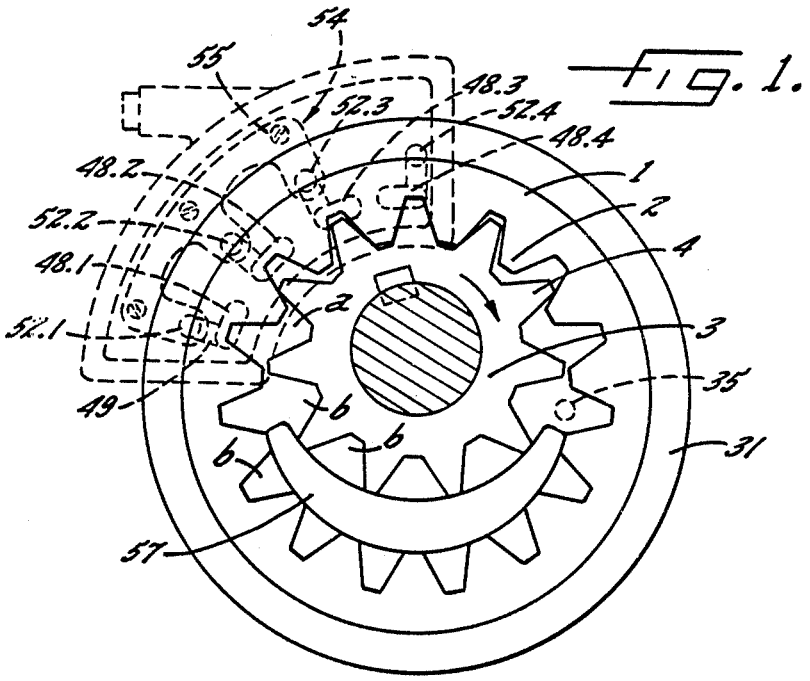
FIG. 1 is a sectional front view of a hydraulic pump embodying the features of the present invention.
Figure 2:
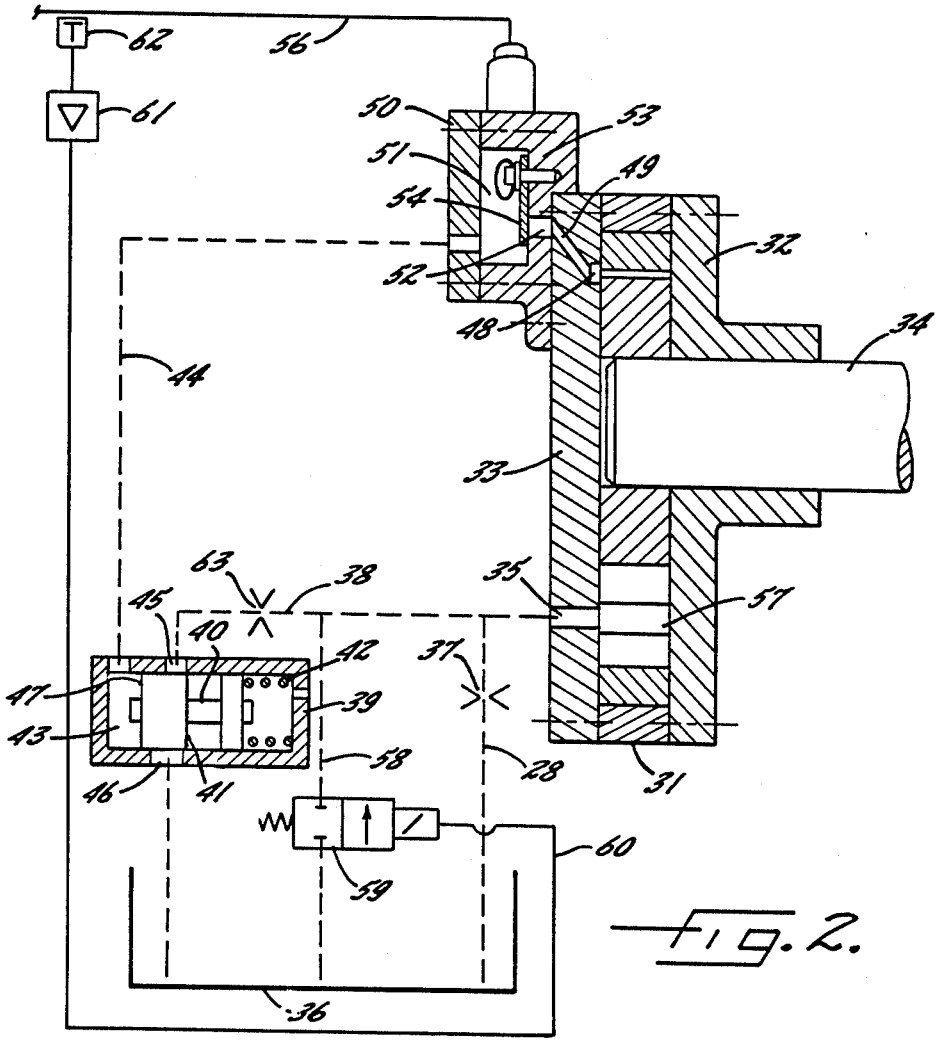
FIG. 2 is a sectional side elevation view of the pump shown in FIG. 1, together with a schematic illustration of the control means of the present invention.

Referring more particularly to FIGS. 1 and 2, a hydraulic pump is illustrated which comprises a pump housing 31, which is closed on its front and rear sides by covers 33 and 32 respectively. A shaft 34 is rotatably supported in the cover 32 and is driven by a suitable motor (not shown).

A toothed internal gear 1 is rotatably mounted within the housing 31 to define a central axis. Also, a toothed external or pinion gear 3 is fixedly mounted on the shaft 34, and so that the gear 3 rotates about the axis of the shaft 34 which is eccentric to the central axis defined by the gear 1. The external gear 3 has a tooth system 4 which meshes with the internal tooth system 2 of the internal gear 1. A crescent shaped bar 57 is mounted in the housing and between the teeth of the gears to provide additional support for the rotating gears.

The meshing teeth of the gears 1, 3 define fluid cells 1, b (FIG. 1) which are alternately expanded and compressed during rotation of the gears. Also, a fluid inlet means is provided for delivering a fluid such as oil to each of the fluid cells while the cells are in an expanded condition. This fluid inlet means comprises an inlet port 35 in the cover 33 of the pump housing, a supply tank 36, and a first fluid line 28 extending from the tank 36 to the pot 35. A fixed throttle 37 is mounted in the line 28.

The fluid inlet means also includes a second fluid line 38 which is parallel to the first line 28, and with the second line 38 including a pressure control valve 39 therein. The valve 39 includes a piston 40 which is axially movable in a supporting cylinder so as to control the passage of the fluid from the tank 36 and through the inlet 46 and outlet 45 in the cylinder, and which is connected in the line 38. For this purpose, the piston includes a control edge 41 which cooperates with the inlet 46 and outlet 45, and the piston is biased by a spring 42 toward the left as seen in FIG. 2 and so as to open passage through the inlet and outlet. The opposite edge 47 of the piston is biased by the pressure in a control chamber 43, and which is connected via a control line 44 to the output pressure of the pump as further described below. As long as there is little or no discharge pressure in the control line 44 and in the control chamber 43, the piston releases the passage from the inlet 46 to the outlet 45, and fluid can then flow from the tank 36 to the pump via both the first line 28 and the throttle 37, and through the second by-passing line 38. When the pressure in the control chamber 43 increases and overcomes the force of the spring 42, the inlet 46 is closed relative to the outlet 45. At this point, only a throttled oil stream continues to flow from the tank 36 through the first line and throttle 37, and to the inlet port 35 of the pump. If the outlet pressure continues to increase, the pressure control valve 39 will operate as a pressure relief valve. More particularly, the spring 42 is compressed to an extent such that the front control edge 47 of the piston opens the pressure line 44 to the inlet 46 and to the tank 36.

The fluid inlet port 35 is positioned so as to deliver the fluid to the fluid cells while they are in an expanded condition. Also, fluid outlet means communicates with these fluid cells during compression thereof and such that the fluid in the cells is expelled through the fluid outlet means. More particularly, the fluid outlet means includes four outlet entrances 48.1, 48.2, 48.3, and 48.4, which are formed in the inside surface of the cover 33, and each of the outlet entrances is connected with an outlet passage 49 which extends through the cover 33. Each outlet passage extends radially outwardly, as best seen in FIG. 2, and as a result, each outlet passage terminates on the outside of the cover as closely as possible to the housing 31.

A discharge housing 50 is mounted on the cover 33 in a pressure tight arrangement, and the housing 50 forms a discharge chamber 51. The chamber 51 of the housing 50 includes openings 52.1, 52.2, 52.3, and 52.4 in the wall 53 thereof which respectively communicate with the four passages 49. Thus the chamber 51 is connected to all of the outlet entrances 48.1–48.4 via the four passages 49, and openings 52.1–52.4. The openings are closed by a one-way, non-return valve of flexible material 54, which is in the form of a M-shaped plate which is secured to the wall 53 of the discharge housing 50 by bolts.

The M-shaped plate of the valve 54 defines blades which project from a transverse section 55 and so that the blades cover the openings 52.1–52.3 respectively. As a result, these blades function as one way non-return valves, and they function to open the connection from the fluid cells formed between the teeth, via the outlet entrances 48.1–48.3, passages 49, and bores 52.1–52.3 only when the pressure of the associated fluid cell is at least equal to the pressure in the discharge chamber 51. The final and most compressed fluid cell and which is located adjacent the pitch point at the intersection of the pitch circles, is connected via the entrance 48.4 and the corresponding passage 49 and opening 52.4, directly into the discharge chamber 51, without having a one way valve therein. The discharge chamber 51 in turn has an outlet which leads to a common outlet duct 56.

To now describe the operation of the pump, when a low pressure is present in the discharge chamber 51, the spring 42 moves the piston 40 to the left as seen in FIG. 2. The pump then operates as a normal internal gear pump, and the oil flows through the first line 28 and throttle 37, and through the parallel second line 38, to the inlet port 35. The fluid cells in the area of the inlet port 35 are filled to their maximum, and the fluid is expelled when the cells move through the discharge side of the pump. Whether the filling is complete or only partial depends on the resistance of the throttle 37 and the by-pass duct 38. Schematically illustrated in FIG. 2 is a throttle 63, which indicates that the by-pass 38 also has a throttling effect, which may result in the fact that the fluid cells are only partially filled at high speeds, as further explained below.

When the pressure in the discharge chamber 51 increases, the by-pass line 38 is initially closed by the valve 39. At this point, only a heavily throttled fluid stream reaches the intake side of the pump, and as a result, the fluid cells on the intake side are only partially filled. Also, a partial vacuum is present in the fluid cells, which results in the fact that the pressure in the cells on the discharge side of the pump is initially lower than the pressure in the discharge chamber 51. Consequently, the blades of the non-return valve 54 remain closed. However, as the cells become progressively smaller on the discharge side, the pressure increases in the cells, and those blades of the non-return valve open where the pressure in the cell is higher than or equal to the pressure in the discharge chamber 51. As a result, the pump continues to deliver a speed independent, constant quantity of fluid, and it is not necessary, even as the speed increases, to divert an excessive quantity of the fluid to a sump so as to incur corresponding losses of efficiency as is the case with conventional systems. The pump is therefore particularly suitable for use in supplying lubricating oil to an internal combustion engine of an automobile. If, in such a case, the requirement for lubricating oil increases, resulting for example from wear, the threshold pressure in the pressure chamber 51 will be reached only at a higher speed. Consequently, the by-pass line 38 closes at a later time, and as a result thereof, the pump adapts itself automatically to an increased demand. Thus the lubricating oil pump will also satisfy an increasing need for lubricating oil during the entire service life of the engine. At the same time, the pump will operate economically also in a new motor which requires relatively little lubricating oil, since a portion of the output which is not needed, is prevented from having to be diverted, with energy loss, to a sump.

The pump of the present invention also meets the additional requirements of special operating conditions. Thus, for example, the lubricating oil may heat excessively in a motor vehicle engine, or the engine parts may require cooling by the oil by reason of special operating conditions. In these instances, and as shown in FIG. 2, an additional by-pass or third fluid line 58 is provided between the inlet port 35 of the pump and the tank 36. Also, an electromagnetically operated valve 59 is positioned in this line 58. The valve 59 is actuated, for example, by a temperature sensor 62, which sends a signal through the amplifier 61 and line 60 to the valve 59. The temperature sensor permits the detection of the oil temperature, or the temperature of a machine part, such as a piston. In a like manner, it is possible to use another measuring instrument, such as a tachometer, rather than a temperature sensor 62, for detecting other extraordinary operating conditions. In any case, the valve 59 serves the purpose of satisfying the extraordinary demand. It will be understood that the sum of the oil delivered through the first line 28 and throttle 37, and through the by-pass line 38, is still throttled to some degree, and as a result, the cells of the internal gear tooth system may be only partially filled despite the opened control pressure valve 39, when speeds above a predetermined threshold speed are reached. The line 58 and valve 59 are thus able to provide a further output under these conditions.

Figure 3:
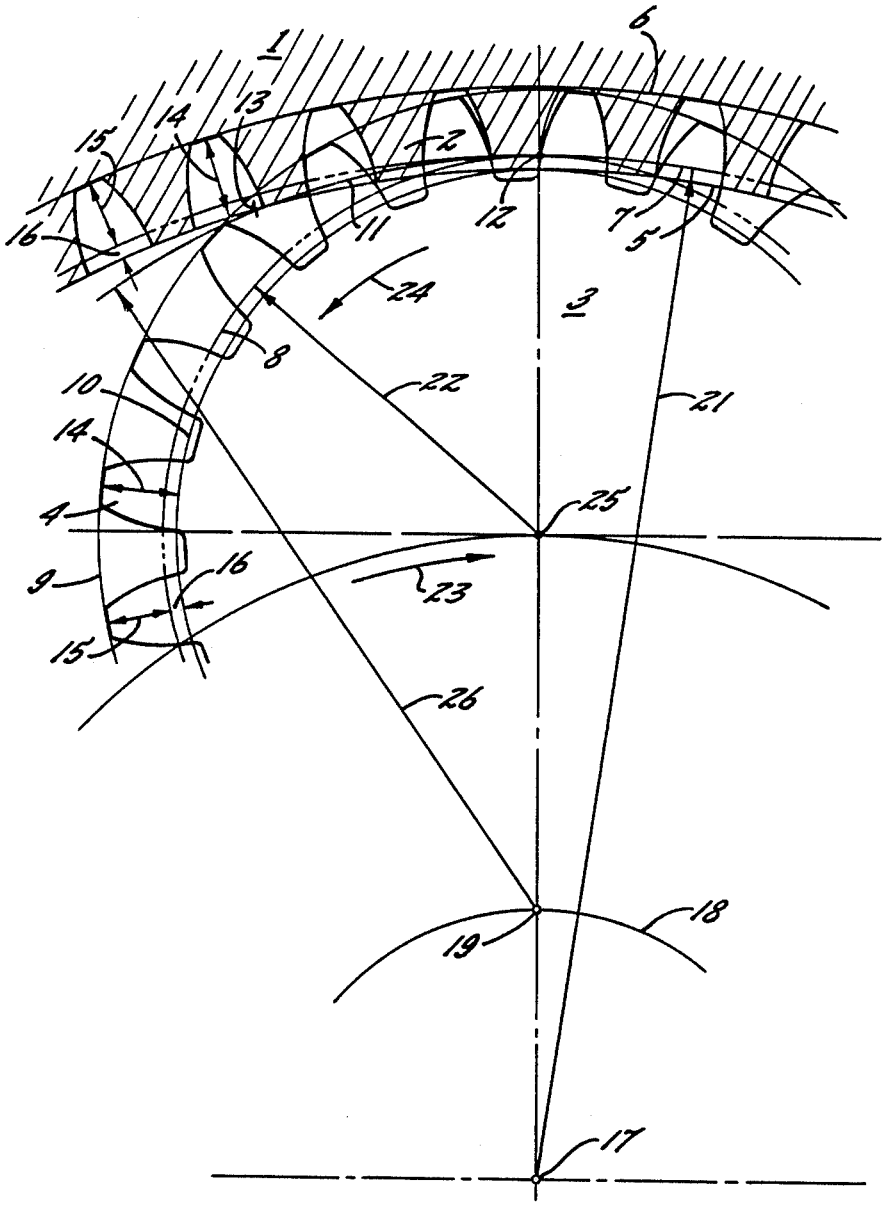
FIG. 3 is a diaghragm of intermeshing gear teeth which are suitable for use with the present invention.

The efficiency of the pump of the present invention depends in part upon the design of the gear tooth system, and such that the teeth mesh with each other in the discharge area between the intersections of the addendum circles, and form enclosed fluid cells which take into account the viscosity of the hydraulic fluid. FIG. 3 illustrates a suitable gear tooth construction, and which is preferably used within the framework of the present invention. The internal gear 1 is provided with teeth 2, which mesh with the teeth 4 of the external gear 3. The external gear 3 rotates in the direction of arrow 24 and moves relative to the stationary internal gear 1 in the direction of arrow 23. The internal gear 1 has a pitch circle 7, which has a radius 21 and a center at 17, and the external gear 3 has a pitch circle 8, which has a radius 22 and an instantaneous center at 25. The pitch circle 7 of the internal gear 1 is, like the pitch circle 8 of the external gear 3, displaced with respect to the tooth height 14 and the centers 17 and 25 of the pitch circles, and in a direction toward the centers 17 and 25. As a result, the tooth height 14 is divided into a larger portion 15 and a smaller portion 16. More particularly, with respect to the internal gear 1, the larger portion 15 extends between the pitch circle 7 and the dedendum circle 6, and the smaller portion 16 extends between the pitch circle 7 and the addendum circle 5. With respect to the external gear 3, the larger portion 15 extends between the pitch circle 8 and the addendum circle 9, and the smaller portion 16 extends between the pitch circle 8 and the dedendum circle 10. The larger portion 15 is at least twice as large as the smaller portion 16, and it is preferred that the ratio of the lengths between the tooth portions 15 and 16 range from 3.5:1 to 5:1.

The flanks of the teeth 2 and 4 preferably have a cycloidal outline. Also, the line of surface contact 11 which extends through the pitch point 12 and the intersection 13 of the addendum circles 5 and 9, is located on a circle having a radius 26, which has an instantaneous center at 19. As the external gear meshes with the stationary hollow internal gear, the center of curvature at 19 describes a circle 18 concentric to the pitch circle 7 of the internal gear. A straight line connecting the center of 17 of the hollow internal gear and the pitch point 12 intersects the circle 18 at the instantaneous center of curvature of the radius 26. The radius of the circle 18 is determined by the conditions as specified, and the thus resultant shape of the gear teeth accomplishes the desired objectives in an excellent manner.

In the drawings and specification, a preferred embodiment of the invention has been illustrated and described, and although specific terms are employed, they are used in a generic and descriptive sense and not for purposes of limitation.

We claim:

1. A hydraulic pump adapted for supplying lubricating oil to an internal combustion engine, and comprising a pump housing, rotary means rotatably mounted within said pump housing and defining fluid cells which are alternately expanded and compressed upon rotation of said rotary means, fluid inlet means extending through said housing for delivering a fluid to each of said fluid cells while the fluid cells are in an expanded condition, said fluid inlet means including a fluid tank, and first and second parallel fluid lines communicating with said tank, fluid outlet means extending through said housing and communicating with said fluid cells during compression thereof and such that the fluid in such fluid cells is expelled through said fluid outlet means, and pressure controlled valve means operatively connected to said fluid outlet means and to one of said first and second fluid lines, for opening flow through said one line when the pressure in said fluid outlet means is below a predetermined value and closing flow through said one line when the pressure in said fluid outlet means is above a predetermined value, and for opening said fluid outlet means to said tank when a predetermined pressure is present in said fluid outlet means which is above the pressure required to close flow through said one line.

2. The hydraulic pump as defined in claim 1 wherein said fluid inlet means further includes a third fluid line positined in parallel with said first and second fluid lines and communicating with said tank, with said third fluid line being unthrottled and including a selectively actuated valve therein, and means for selectively actuating said valve in response to an externally monitored parameter.

3. The hydraulic pump as defined in claim 1 wherein said pressure controlled valve means includes a slideably mounted piston which is biased by a spring in one direction and by the pressure in said fluid outlet means in the other direction and such that the piston opens flow from said fluid outlet means to said tank when the pressure in said fluid outlet means biases said piston against said spring with a predetermined force.

4. The hydraulic pump as defined in claim 1 wherein said rotary means comprises a toothed internal gear rotatably mounted within said housing to define a central axis, and a toothed external gear mounted within said housing for rotation about an axis which is eccentric to said central axis, and with the teeth of said external gear meshing with the teeth of said internal gear and such that the interengaging teeth define said fluid cells.

5. The hydraulic pump as defined in claim 4 wherein said fluid outlet means includes a plurality of separate outlets extending through said housing and positioned along the rotational direction of said fluid cells, and with the outlets being separated by a distance not greater than the pitch of the teeth of said gears.

6. The hydraulic pump as defined in claim 5 wherein at least the upstream ones of said outlets include one way valve means mounted therein to permit flow only from said housing.

7. The hydraulic pump as defined in claim 4 wherein the flanks of the teeth of said internal and external gears are of cycloidal outline, and wherein the teeth have a curved line of contact which extends substantially through the intersection of the addendum circles, and with the radius of curvature of the line of contact having a length which lies between the radius of the pitch circle of the external gear and the radius of the pitch circle of the internal gear.

8. The hydraulic pump as defined in claim 7 wherein the teeth of the internal gear have a height which comprises a larger portion which extends between the pitch circle and the dedendum circle and a smaller portin which extends between the pitch circle and the addendum circle; and the teeth of the external gear have a height which comprises a larger portion which extends between the pitch circle and the addendum circle and a smaller portion which extends between the pitch circle and the dedendum circle.

9. The hydraulic pump as defined in claim 8 wherein the ratio of the larger portion to the smaller portion of the teeth of both the internal and external gears is at least two to one.

10. A hydraulic pump adapted for supplying lubricating oil to an internal combustion engine, and comprising a pump housing, rotary means rotatably mounted within said pump housing and defining fluid cells which are alternately expanded and compressed upon rotation of said rotary means, fluid inlet means extending through said housing for delivering a fluid to each of said fluid cells while the fluid cells are in an expanded condition, fluid outlet means extending through said housing and communicating with said fluid cells during compression thereof and such that the fluid in such fluid cells is expelled through said fluid outlet means, said fluid inlet means including a first fluid line having a throttle therein for limiting the fluid flow rate therethrough, a second fluid line which is parallel to said first line, with said second line including a pressure controlled valve therein, a fluid tank, with each of said first and second fluid lines communicating with said tank, and a third fluid line positioned in parallel with said first and second fluid lines and communicating with said tank, with said third fluid line being unthrottled and including a selectively actuated valve therein, and control means operatively interconnecting said pressure control valve and said fluid outlet means and for opening the pressure controlled valve when the pressure in said fluid outlet means is below a predetermined value and closing said pressure control valve when the pressure in said fluid outlet means is above a predetermined value, and for selectively actuating said valve in said third fluid line in response to an externally monitored parameter.

* * * * *